US010546672B2

(12) United States Patent
Kato et al.

(10) Patent No.: US 10,546,672 B2
(45) Date of Patent: Jan. 28, 2020

(54) RARE EARTH BASED MAGNET

(71) Applicant: TDK CORPORATION, Tokyo (JP)

(72) Inventors: Eiji Kato, Tokyo (JP); Yoshinori Fujikawa, Tokyo (JP); Taeko Tsubokura, Tokyo (JP); Chikara Ishizaka, Tokyo (JP); Katsuo Sato, Tokyo (JP)

(73) Assignee: TDK CORPORATION, Tokyo (JP)

( * ) Notice: Subject to any disclaimer, the term of this patent is extended or adjusted under 35 U.S.C. 154(b) by 518 days.

(21) Appl. No.: 14/229,253

(22) Filed: Mar. 28, 2014

(65) Prior Publication Data

US 2014/0292453 A1 Oct. 2, 2014

(30) Foreign Application Priority Data

Mar. 28, 2013 (JP) ..... 2013-067862
Dec. 20, 2013 (JP) ..... 2013-263371

(51) Int. Cl.
*H01F 1/057* (2006.01)

(52) U.S. Cl.
CPC ..... *H01F 1/0577* (2013.01); *H01F 1/057* (2013.01); *H01F 1/0573* (2013.01)

(58) Field of Classification Search
None
See application file for complete search history.

(56) References Cited

U.S. PATENT DOCUMENTS 4,888,068 A * 12/1989 Tokunaga ..... H01F 1/0577 148/102
5,147,447 A * 9/1992 Takeshita ..... B22F 3/1003 419/12
5,545,266 A * 8/1996 Hirosawa ..... C22C 1/0441 148/302

(Continued)

FOREIGN PATENT DOCUMENTS

JP H04-359404 A 12/1992
JP H09289127 A * 11/1997 ..... H01F 41/02

(Continued)

OTHER PUBLICATIONS

M. Sagawa. S. Hirosawa. H. Yamamoto. "Nd—Fe—B Permanent Magnet Materials." Japanese Journal of Applied Physics. vol. 26, No. 6, Jun. 1987, pp. 785-800.*

(Continued)

*Primary Examiner* — Paul A Wartalowicz
*Assistant Examiner* — Stephani Hill
(74) *Attorney, Agent, or Firm* — Oliff PLC

(57) ABSTRACT

The present invention provides a rare earth based magnet that inhibits the high temperature demagnetization rate even when less or no heavy rare earth elements such as Dy, Tb and the like are used. The rare earth based magnet according to the present invention includes $R_2T_{14}B$ main phase crystal grains and grain boundary phases between adjacent main phase crystal grains. In any cross-section of the rare earth based magnet, when evaluating the circular degree of the (Continued)

main phase crystal grains with Wadell's Roundness A, the shape of the main phase crystal grains is controlled such that the Roundness A becomes 0.24 or more.

4 Claims, 4 Drawing Sheets

(56) References Cited

U.S. PATENT DOCUMENTS

| | | | | | |
|---|---|---|---|---|---|
| 5,858,123 | A * | 1/1999 | Uchida | B22F 9/04 | 148/302 |
| 6,447,621 | B1 * | 9/2002 | Tokoro | H01F 1/0573 | 148/302 |
| 2013/0026870 | A1 * | 1/2013 | Baba | C22C 38/005 | 310/152 |
| 2014/0132377 | A1 * | 5/2014 | Nakajima | B22F 3/24 | 335/302 |
| 2014/0191831 | A1 * | 7/2014 | Yamazaki | H01F 1/0571 | 335/302 |
| 2014/0341774 | A1 * | 11/2014 | Okuda | B22F 1/0018 | 420/83 |

FOREIGN PATENT DOCUMENTS

| | | | | | |
|---|---|---|---|---|---|
| JP | H10-135019 | A | | 5/1998 | |
| JP | 2000188213 | A | * | 7/2000 | H01F 1/0577 |
| JP | A-2002-327255 | | | 11/2002 | |
| JP | 2005159053 | A | * | 6/2005 | H01F 1/053 |
| JP | A-2012-164764 | | | 8/2012 | |
| JP | WO 2013061784 | A1 | * | 5/2013 | B22F 1/0018 |
| WO | WO-2011122667 | A1 | * | 10/2011 | C22C 38/005 |
| WO | WO-2013008756 | A1 | * | 1/2013 | B22F 3/24 |

OTHER PUBLICATIONS

JP 2005-159053 machine translation (Year: 2005).*
JP 2000-188213 machine translation (Year: 2000).*
Roussillon et al. "Automatic computation of pebble roundness using digital imagery and discrete geometry." Computers & Geoscience (2009) (Year: 2009).*
JP H09-289127 machine translation (Year: 1997).*
WO 2011/122667 machine translation (Year: 2011).*

* cited by examiner

RARE EARTH BASED MAGNET

The present invention relates to a rare earth based magnet, especially a rare earth based magnet obtained by controlling the microstructure of the R-T-B based sintered magnet.

BACKGROUND

The R-T-B based sintered magnet (R represents a rare earth element, T represents one or more elements of iron group elements containing Fe as an essential, and B represents boron), a representative of which is Nd—Fe—B based sintered magnet, is advantageous for miniaturization and high efficiency of the machines using it due to high saturation flux density, and thus can be used in the voice coil motor of the hard disk drive and the like. In recent years, the R-T-B based sintered magnet also has been applicable in various industrial motors, or driving motors of hybrid vehicles, or the like. From the viewpoint of energy conservation and the like, it is desirable that the R-T-B based sintered magnet can be further popularized in these fields. However, when applied in the hybrid vehicles and the like, the R-T-B based sintered magnet will be exposed to a relatively high temperature. Therefore, inhibition of the high temperature demagnetization caused by heat becomes important. For inhibition of the demagnetization under high temperature, a method for sufficiently improving coercivity of the R-T-B based sintered magnet at room temperature is well known as effective.

For example, as a method for improving a coercivity of the Nd—Fe—B based sintered magnet at room temperature, a method in which part of Nd of the compound $Nd_2Fe_{14}B$ as the main phase is replaced with heavy rare earth elements such as Dy, Tb and the like is well known. By replacing part of Nd with the heavy rare earth elements, the magnetic anisotropy of crystals is increased, and as a result, the coercivity of the Nd—Fe—B based sintered magnet at room temperature can be sufficiently improved. In addition to the replacement with heavy rare earth elements, addition of elements such as Cu and the like is also effective in improving coercivity at room temperature (Patent Document 1).

As a method for improving coercivity by controlling the microstructure, i.e., the structures of the $R_2T_{14}B$ main phase crystal grains of the rare earth based magnet and the grain boundary phases, the technique disclosed in Patent Document 2 is known. Patent Document 2 discloses a rare earth based magnet which is a magnetic body including main phase crystal grains of the tetragonal intermetallic compound ($R_2Fe_{14}B$) and grain boundary phases formed among the crystal grains. The crystal grains have a round-corner shape with a maximum width of 500 nm, and the grain boundary phases have a minimum width of 1 nm or more. Here, the maximum width means the maximum length of a crystal grain in the direction perpendicular to the easy magnetization axis (axis c) shown in the section shape when the main phase crystal grain is cut by a plane parallel to axis c. Moreover, the round-corner shape means that any angular part is not found in the section shape. That is, the above round-corner shape means, unlike a rectangular shape of the existing crystal grains, the angles forming the rectangle become substantially arc-shaped. It is considered that by means of forming such a structure, the influence of the demagnetizing field at the angles of the crystal grains is reduced, resulting in inhibition of the occurrence of reverse magnetic domain in the crystal grains and the like, and improvement of a coercivity of the magnetic body.

Patent Documents

Patent Document 1: JP2002-327255
Patent Document 2: JP2012-164764

SUMMARY

In the case of using the R-T-B based sintered magnet at a high temperature of 100° C. ~200° C., although the value of coercivity at room temperature is one of the effective indicators, no demagnetization or little demagnetization rate even when practically exposed to a high temperature environment is very important. Although coercivity of the composition in which part of R of the compound $R_2T_{14}B$ as the main phase is replaced by the heavy rare earth elements such as Tb or Dy is sharply improved and this is a simple method for being a high coercivity, there are problems in terms of the resources since the heavy rare earth elements such as Tb, Dy and the like are limited in producing areas and yields. Accompanied with replacement, it is unavoidable for e.g., decrease of residual flux density due to antiferromagnetic coupling of Nd and Dy. Addition of the element Cu as described above and the like are also effective. Nonetheless, in order to enlarge the applicable field of the R-T-B based sintered magnet, it is desirable that the inhibition on the high temperature demagnetization (demagnetization due to exposure to a high temperature environment) is further enhanced.

However, in the case of improving coercivity of the rare earth based magnet, the microstructure of the sintenred body has been investigated before based on a guideline shown as follows. That is, $R_2T_{14}B$ crystal grains as the main phase are shaped into a cuboid elongated in the easy magnetization axis, and a structure in which grain boundary phases formed between the adjacent main phase grains are thick enough to cut off the magnetic coupling between the main phase grains is formed. As such, the grains are shaped to elongate in the direction of easy magnetization, thereby reducing the influence of demagnetizing field, and thus inhibiting the occurrence of the reverse magnetic domain which is a primary cause for decrease of coercivity. Moreover, it is thought that by forming grain boundary phases with an enough thickness to cut off the magnetic coupling between the main phase grains, occurrence of the reverse magnetic domain resulting from the magnetic influence of the adjacent grains can be inhibited. As a result, a high coercivity can be achieved, and the high temperature demagnetization rate can be inhibited. Although the clue of Patent Document 2 in which coercivity, i.e., the effect on inhibiting the high temperature demagnetization rate, will be improved if the main phase crystal grains of the rare earth based magnet are shaped into a round-corner is one of the effective techniques for obtaining a magnet with high performances without using the heavy rare earth elements such as Dy, Tb and the like, there is not any disclosure with respect to realizing the grains with such a desired shape produced by a powder metallurgic method in an industrial scale. In addition, it is unclear that the round-corner shape, to what extent, is effective in improving coercivity, i.e., inhibiting the high temperature demagnetization rate.

Therefore, the purpose of the present invention is to provide a rare earth based magnet that enhances inhibition on the high temperature demagnetization rate based on the quantitative evaluation of the shape of the main phase crystal grains in the rare earth based magnet produced by a powder metallurgic method.

The present inventors have made an effort to investigate the shape of the main phase grains having a high effect of inhibiting the high temperature demagnetization rate, which can be achieved in an industrial scale even during the existing powder metallurgic process, and thus the present invention has been accomplished.

That is, the rare earth based magnet according to the present invention is characterized in comprising $R_2T_{14}B$ main phase crystal grains and grain boundary phases between adjacent main phase crystal grains, wherein in any section of the rare earth based magnet, when the circular degree of the main phase crystal grains is evaluated by the Wadell's Roundness A, A is 0.24 or more.

Meanwhile, an evaluation method of the Wadell's Roundness A is described later. That is, the present inventors have made an effort to investigate the structures of the main phase crystal grains that can be achieved practically, and as a result, they have found that the above technical problem can be solved by forming the corners of the main phase grains into a roundish shape or an ellipsoid shape, which deviates from the current guideline, instead of shaping the main phase crystal grains into a cuboid elongated in a direction of the easy magnetization axis, which has always been believed to be advantageous, and thus the present invention has been accomplished.

By forming the microstructure of the rare earth based magnet into such a structure, the surface of the main phase crystal grains is smooth, and thus the occurrence of the reverse magnetic domain can be inhibited as the local area susceptible to the demagnetizing field is reduced. Further, a thick area in the grain boundary phase between the adjacent $R_2T_{14}B$ main phase crystal grains may be added, and thus the magnetic coupling between the main phase crystal grains is cut off, thereby inhibiting the occurrence of the reverse magnetic domain caused by the influence of the adjacent crystal grains. As a result, the high temperature demagnetization rate can be inhibited.

The grain boundary phase between said adjacent $R_2T_{14}B$ main phase crystal grains is preferably a phase in which the concentration of the non-magnetic rare earth element R is relatively high (R-rich phase). Further, the phase may be antiferromagnetic or ferrimagnetic compounds. By forming the grain boundary phase as such, magnetic isolation of the main phase crystal grains is enhanced. As a result, the high temperature demagnetization rate of the rare earth based magnet can be sharply inhibited.

According to the present invention, a rare earth based magnet with a low demagnetization rate at a high temperature can be provided, and a rare earth based magnet applicable in the motors and the like used in a high temperature environment can be provided.

DETAILED DESCRIPTION OF EMBODIMENTS

Hereinafter, the preferred embodiments of the present invention are illustrated while making a reference to the drawings. Moreover, the rare earth based magnet according to the present invention is a sintered magnet comprising $R_2T_{14}B$ main phase crystal grains and grain boundary phases, and contains B and additional components that are to add various well known elements, and R contains one or more rare earth elements. T contains one or more elements of iron group including Fe as an essential element.

Figure 2:
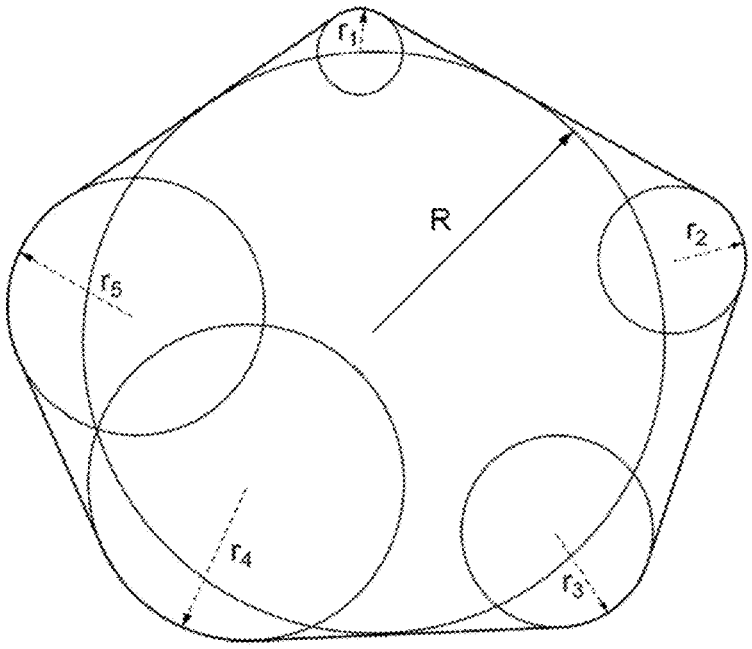
FIG. 2 is a drawing illustrating the evaluation method of the Roundness in the present embodiment.

FIG. 2 is a drawing schematically illustrating the cross-section structure of the rare earth based magnet of the embodiments according to the present invention. The rare earth based magnet according to the present embodiment is a magnet with the cross-section of the $R_2T_{14}B$ main phase crystal grains having a roundish shape.

Firstly. Wadell's Roundness, as the evaluation index of the circular degree of the main phase crystal grains in the present invention, is described on the basis of FIG. 2. In the present specification, Roundness A is defined by formula (1) below.

$$A=\Sigma r_i/(Rn) \quad (1)$$

Here, $r_i$ represents the radius of a circle inscribed in a corner of a selected crystal grain, R represents the radius of the biggest circle inscribed in the selected crystal grain, n represents the number of the corners of the selected crystal grain, and Σ represents the sum of the corners of the selected crystal grain.

Based on this definition, in the case that the selected grain is an ideal circle (sphere), Roundness A is 1. Therefore, the Roundness described in the present specification does not exceed 1. In view of the schematic drawing of FIG. 2, the crystal grain has 5 corners (n=5), and the radiuses of circles inscribed in these corners are $r_1$, $r_2$, $r_3$, $r_4$ and $r_5$, respectively, and the radius of the biggest circle inscribed is R.

Next, the evaluation for the high temperature demagnetization rate of the rare earth based magnet according to the present embodiment is described. The shape of the sample used for evaluation is not particularly limited, and for example, it is a shape, that is generally used, with a Permeance Coefficient of 2. Firstly, residual flux of the sample at room temperature (25° C.) is measured and taken as B0. The residual flux may be measured by for example a magnetic flux meter. Next, the sample is exposed to a high temperature of 140° C. for 2 hours, and then returns to the room temperature. Once the temperature of the sample returns to the room temperature, the residual flux is measured again and taken as B1. As such, the high temperature demagnetization rate D is evaluated by the formula (2) below.

$$D=(B1-B0)B0*100(\%) \quad (2)$$

Since the above Roundness is allowed to be 0.24 or more, the rare earth based magnet according to the present embodiment is formed such that the gap between the main phase crystal grains is larger than that of a current structure filled with rectangular grains. Thus, magnetic isolation of the adjacent main phase crystal grains is enhanced, and the high temperature demagnetization rate is inhibited.

Hereinafter, an example of the method for producing the rare earth based magnet according to the present embodiment is described.

The composition of the rare earth based magnet according to the present embodiment is formed such that in comparison to the element T, the element R is excessive to the stoichiometric ratio of $R_2T_{14}B$. Specifically, atomic percentage of R may be around 14.4%. Moreover, the rare earth based magnet according to the present embodiment may be produced by a usual powder metallurgic method comprising a preparation step of producing the raw alloys, a pulverization step of pulverizing the raw alloys to obtain raw fine powders, a molding step of molding the raw fine powders to obtain a molded body, a sintering process of firing the molded body to obtain a sintered body, and an heat treating step of subjecting the sintered body to an aging treatment.

The preparation step is the step for producing the raw alloys having the elements contained in the rare earth based magnet according to the present embodiment. Firstly, the raw metals having the specified elements are prepared, and subjected to a strip casting method and the like. The raw alloys are thus produced. As the raw metals, for examples, rare earth based metals or rare earth based alloys, pure iron, pure cobalt, ferroboron or alloys thereof are exemplified. These raw metals are used to produce the raw alloys of the rare earth based magnet having the desired composition.

The pulverization step is the step for pulverizing the raw alloys obtained in the preparation step into raw fine powders. This step is preferably performed in two stages comprising a coarse pulverization step and a fine pulverization step, and may also be performed as one stage. The coarse pulverization may be performed by using, for example, a stamp mill, a jaw crusher, a braun mill and the like under an inert gas atmosphere. A hydrogen adsorption pulverization in which pulverization is performed after adsorbing hydrogen may also be performed. In the coarse pulverization step, the raw alloys are pulverized until the particle size is around several hundred micrometers to several millimeters.

The fine pulverization step is the step in which the coarse powders obtained in the coarse pulverization step is finely pulverized to prepare the raw fine powders with the average particle size of several micrometers. The average particle size of the raw fine powders may be set under the consideration of the growth of the crystal grains after sintering. For example, the fine pulverization may be performed by a jet mill.

The molding step is a step for molding the raw fine powders in the magnetic field to produce a molded body. Specifically, after the raw fine powders are filled into a mold equipped in an electromagnet, the molding is performed by orientating the crystallographic axis of the raw fine powders by applying a magnetic field via the electromagnet, while pressurizing the raw fine powders. The molding may be performed in a magnetic field of 1000~1600 kA/m under a pressure of about 30~300 MPa.

The sintering step is a step for firing the molded body to obtain a sintered body. After being molded in the magnetic field, the molded body may be fired in a vacuum or an inert gas atmosphere to obtain a sintered body. Preferably, the firing conditions are suitably set depending on the factors such as composition of the molded body, the pulverization method of the raw fine powders, grain size and the like. For example, the sintering may be performed at 1000° C.~1100° C. for 1~10 hours.

The heat treating step is a step for subjecting the sintered body to an aging treatment. After this step, the Roundness A of the $R_2T_{14}B$ main phase crystal grains and the width of the grain boundary phases are determined. However, these microstructures are not only controlled in this step, but are determined in view of the conditions of the above sintering step and the situation of the raw fine powders. Hence, the relationship between the conditions of the heat treatment and the microstructure of the sintered body may be considered to set the temperature and time period of the heat treatment. The heat treatment may be performed at a temperature ranging from 400° C. to the sintering temperature, and may also be performed in two stages comprising a heat treatment at 800° C. nearby followed by a heat treatment at 550° C. nearby. The cooling rate during the cooling process of the heat treatment may also alter the microstructure. The cooling rate is preferably 100° C./min or more, particularly preferably 300° C./min or more. By the above aging treatment of the present invention in which the cooling rate is faster than before, the segregation of the ferromagnetic phase in the grain boundary phase can be effectively inhibited. Thus, the causes for reducing coercivity and further deteriorating the high temperature demagnetization rate can be eliminated. By respectively setting the composition of the raw alloys, the above sintering conditions and the conditions of heat treatment at 800° C. nearby, the shape of the main phase crystal grains can be controlled. Here, an example of the heat treatment step is described as the method for controlling the shape of the main phase crystal grains. The shape of the main phase crystal grains may also be controlled by the following main factors of the composition.

According to the information based on the experiments of the inventors, it is considered that by suitably selecting the additive elements besides the elements R, T and B of the main phase crystal grains, the corners of the main phase are melt in the heat treatment at a high temperature of 800° C. nearby, the corners of the main phase crystal grains are made to be rounded, and the elements R and Fe precipitate in the grain boundary phases. Based on such a mechanism, the raw alloys are taken as R-rich composition, and the non-magnetic R-rich phase precipitates in the grain boundary phases. Further, as the additive elements, the elements that, together with R and T, form compounds with a magnetic structure having antiferromagnetism, ferrimagnetism or the like different from ferromagnetism are preferred. Specifically, Al, Ge, Si, Sn, Ga and the like may be added, and other elements may also be feasible, as long as compounds with a magnetic structure different from a ferromagnetic structure can be formed. As such, if the non-magnetic R-rich phase precipitates in the grain boundary phase or the grain boundary phase become an antiferromagnetic or ferrimagnetic compound, magnetic isolation of the main phase crystal grains is easily resulted, and the high temperature demagnetization rate and the like are inhibited. Thus, a magnet having excellent magnetic properties is formed.

In addition, O contained in the resultant rare earth based magnet may be measured by an inert gas fusion-nondispersive infrared absorption method, C may be measured by a combustion in oxygen flow-infrared absorption method. N may be measured by an inert gas fusion-thermal conductivity method. The composition of the rare earth based magnet according to the present embodiment is formed such that, in comparison to the element T, the element R is excessive to the stoichiometric ratio of $R_2T_{14}B$. Further, when the atom numbers of the contained C, O and N are denoted as [C], [O], and [N] respectively, the relationship of $[O]/([C]+[N])<0.60$ is preferably satisfied. With such a composition, the absolute value of the high temperature demagnetization rate can be inhibited to be small.

Next, the present invention is further described in detail with reference to the specific examples, but the present invention is not limited thereto.

EXAMPLES

Nd was used as the element R, and Fe was used as the element T. In addition, Cu and Ga were used as the additive elements for forming the grain boundary phases. The raw metals of the rare earth based magnet were prepared. The composition having various elements consisting of Nd: 31.08 mass %,
B: 0.95 mass %,
Ga: 0.72 mass %,
Cu: 0.10 mass %, Fe (the residual part except the inevitable impurities and the like is Fe): balance, and other inevitable impurities and the like: 1 mass % or less, were dissolved, and raw alloys were prepared by a strip casting method. Further, in order to form thicker grain boundary phases, a composition that was richer in Nd and Ga than the above composition also could be prepared. Next, after adsorption of hydrogen onto the resultant raw alloys, hydrogen pulverization by desorbing hydrogen was performed in Ar atmosphere at 600° C. for 1 hour. Then, the resultant pulverized materials were cooled to room temperature in Ar atmosphere.

After adding oleic amide as a grinding aid to the resultant pulverized materials and mixing therewith, a fine pulverization was performed by using a jet mill to obtain raw powders with an average particle size of 3~4 μm.

The resultant raw powders were molded in a low-oxygen atmosphere under the condition of an alignment magnetic field of 1200 kA/m and a molding pressure of 120 MPa to obtain a molded body.

Then, the molded body was fired in a vacuum at 1060° C. for 3 hours, and quenched to obtain a sintered body.

For the resultant sintered body, various samples with the main phase crystal grains different in Roundness were prepared by varying the temperature, time period, cooling rate of the cooling process in the heat treatment as illustrated in Tables 1 and 3. Moreover, the Roundness of the main phase crystal grains may also vary depending on the composition of the raw alloys and the sintering conditions.

TABLE 1

| Sample No. | Temperature of heat treatment (° C.) | Time period of heat treatment (hr) | Roundness | High temperature demagnetization rate (%) |
|---|---|---|---|---|
| Comparative Example 1 | 850 | 0.2 | 0.15 | −2.3 |
| Comparative Example 2 | 850 | 0.5 | 0.16 | −2.2 |
| Comparative Example 3 | 850 | 1 | 0.19 | −2.1 |
| Comparative Example 4 | 850 | 5 | 0.21 | −2.1 |
| Example 1 | 700 | 0.2 | 0.24 | −0.77 |
| Example 2 | 700 | 0.5 | 0.26 | −0.51 |
| Example 3 | 700 | 1 | 0.31 | −0.27 |
| Example 4 | 700 | 5 | 0.35 | −0.2 |
| Example 5 | 700 | 20 | 0.36 | −0.18 |

For the samples obtained as above, firstly, the high temperature demagnetization rate was measured, and then the cross-section was observed by an electron microscope, followed by measurement of the Roundness and observation of the grain boundary phases. For the Roundness, five grains with different sizes were measured respectively, and the average of these measured values was taken as the Roundness of the sample. Table 2 illustrated a specific example of Roundness measurement for one main phase crystal grain from the example and the comparative example, respectively. The main phase crystal grain of the evaluated example as Example 1 had 10 corners, and the radiuses of circles inscribed in respective corners were indicated as the values shown in Table 2. Moreover, the main phase crystal grain of the evaluated example as Comparative Example 1 had 7 corners, and the radiuses of circles inscribed in respective corners were indicated as the values shown in Table 2. For the respective examples and comparative examples, the residual 4 crystal grains were subjected to the same measurements, and the average was taken as the Roundness.

TABLE 2

| | Example 1 | Comparative Example 1 |
|---|---|---|
| R(μm) | 7.98 | 4.23 |
| r1(μm) | 3.04 | 2.2 |
| r2(μm) | 1.48 | 1.15 |
| r3(μm) | 1.4 | 0.79 |
| r4(μm) | 2.95 | 0.43 |
| r5(μm) | 2.03 | 0.15 |
| r6(μm) | 3.11 | 0.15 |
| r7(μm) | 4.83 | 0.04 |
| r8(μm) | 0.39 | — |
| r9(μm) | 0.39 | — |
| r10(μm) | 1.05 | — |
| n | 10 | 7 |
| Roundness A | 0.26 | 0.17 |

Additionally, when the atom numbers of the elements N, C and O contained in the resultant rare earth based magnet were denoted as [N], [C] and [O] respectively, the values of [O]/([C]+[N]) of respective samples were calculated and shown in Table 3. The amounts of oxygen and nitrogen contained in the rare earth based magnet were adjusted to the ranges shown in Table 3 by controlling the atmospheres from the pulverization step to the heat treating step, especially adjusting the amounts of oxygen and nitrogen contained in the atmosphere in the pulverization step. Moreover, the amount of carbon contained in the raw materials of the rare earth based magnet was adjusted to the range shown in Table 3 by adjusting the amount of the grinding aid added in the pulverization step.

TABLE 3

| Sample No. | Amounts of N, C, O contained in the rare earth based magnet | | | Ratio of Atom numbers [O]/[C] + [N]) | Cooling rate of the heat treatment ° C./min |
|---|---|---|---|---|---|
| | N mass % | C mass % | O mass % | | |
| Comparative Example 1 | 0.05 | 0.09 | 0.11 | 0.62 | 60 |
| Comparative Example 2 | 0.05 | 0.09 | 0.11 | 0.62 | 60 |
| Comparative Example 3 | 0.05 | 0.09 | 0.10 | 0.57 | 100 |
| Comparative Example 4 | 0.05 | 0.09 | 0.10 | 0.57 | 100 |
| Example 1 | 0.05 | 0.09 | 0.08 | 0.45 | 100 |
| Example 2 | 0.05 | 0.09 | 0.08 | 0.45 | 100 |
| Example 3 | 0.05 | 0.09 | 0.08 | 0.45 | 100 |
| Example 4 | 0.05 | 0.09 | 0.09 | 0.51 | 300 |
| Example 5 | 0.05 | 0.09 | 0.09 | 0.51 | 300 |

Figure 1:
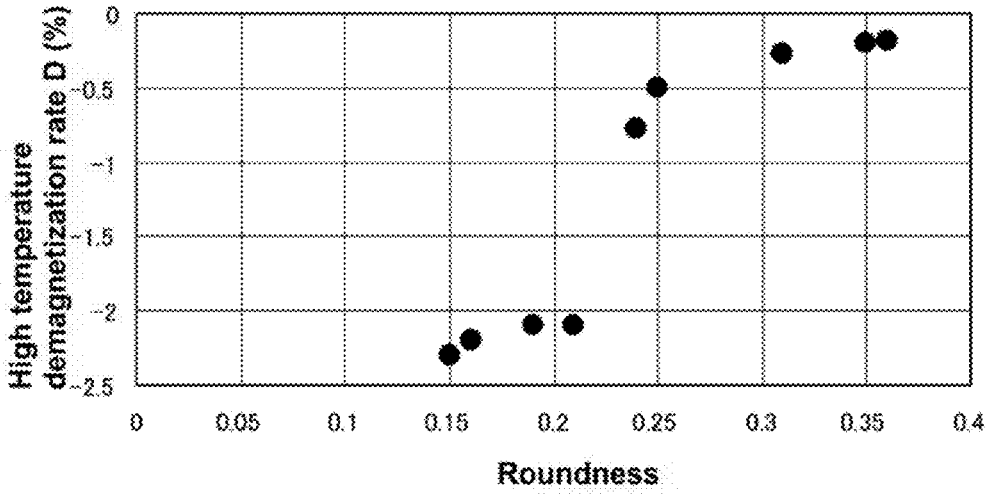
FIG. 1 is a drawing showing the relationship between the Roundness and the high temperature demagnetization rate according to the present embodiment.

FIG. 1 is a drawing showing the relationship between the Roundness A of the examples and the comparative examples evaluated by the above method and the high temperature demagnetization rate D. It can be seen from FIG. 1 that the effect on inhibiting the high temperature demagnetization rate D was especially improved when the Roundness A was 0.24 or more.

Figure 3:
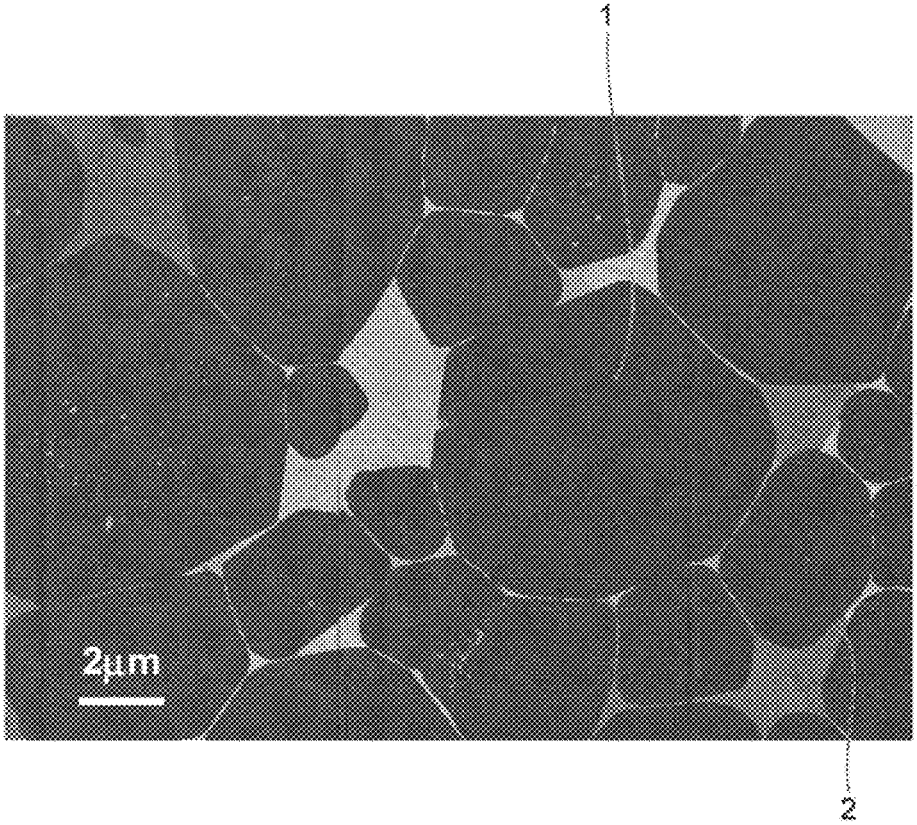
FIG. 3 is a cross-section photograph exhibiting the microstructure of the rare earth based magnet of the example.

FIG. 3 is a cross-section photograph exhibiting the microstructure of the rare earth based magnet according to the present embodiment. The Roundness A of the rare earth based magnet was 0.31, and the high temperature demagnetization rate was inhibited to a low value of −0.27%. It can be seen from FIG. 3 that an extremely broad grain boundary phase was formed between the roundish main phase crystal grains. By the above heat treatment at a high temperature, the corners of the main phase crystal grains were melted, and based on it, thick grain boundary phases were formed, allowing the main phase crystal grains to have a smooth surface and to be magnetically isolated. If analyzing the composition of the grain boundary phase, it can be confirmed that Nd-rich phase with 90 at % of Nd was formed, or the antiferromagnetic compound $Nd_6Fe_{13}Ga$ phase and the like was formed even containing the element Fe. By allowing the composition of the raw alloys to be rich in R and further adding Ga and the like, the grain boundary phase might be formed into a magnetic structure that is not ferromagnetic, resulting in magnetic isolation of the main phase crystal grains.

Figure 4:
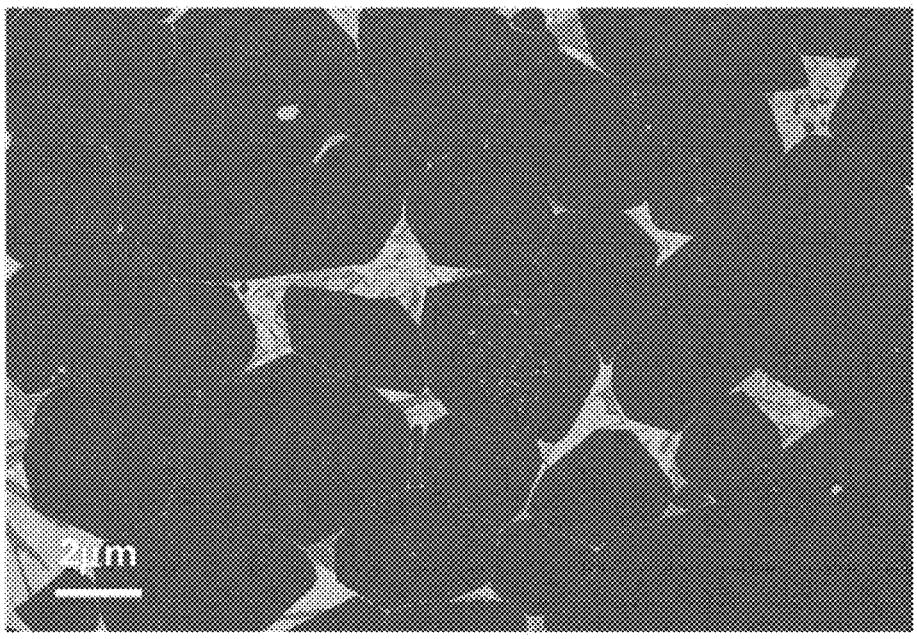
FIG. 4 is a cross-section photograph exhibiting the microstructure of the rare earth based magnet of the comparative example.

FIG. 4 is a cross-section photograph exhibiting the microstructure of the rare earth based magnet of the comparative example. Although the comparative example had an approximately the same composition as the above example, the main phase crystal grains were formed into an angular shape due to insufficient heat treatment at a high temperature. The Roundness A of the rare earth based magnet of the comparative example was 0.15, and the high temperature demagnetization rate was up to −2.3%.

Additionally, as shown in Table 3, in the samples of Examples 1-5 that meet the requirements of the present invention, the above microstructure was formed in the sintered magnet, and the atom numbers of O, C and N contained in the sintered magnet satisfied the following specific relationship. That is, when the atom numbers of O, C and N were denoted as [O], [C], and [N] respectively, the relationship of $[O]/([C]+[N])<0.60$ was satisfied. As such, when $[O]([C]+[N])<0.60$, the high temperature demagnetization rate D can be effectively inhibited.

As demonstrated by the above examples, by forming the $R_2T_{14}B$ main phase crystal grains into a roundish shape with the Roundness A being 0.24 or more, the rare earth based magnet according to the present invention can allow the width of the grain boundary phase formed adjacent to the main phase crystal grains to become thick, and the high temperature demagnetization rate is inhibited to be low.

The present invention was described with reference to the embodiments above. The embodiments were exemplified, and various modification and changes may be included within the claims of the present invention. In addition, one skilled in the art will understand that the modified examples and changes are within the claims of the present invention. Thus, the description and the drawings in the present specification should be considered as illustrative but not limited.

According to the present invention, a rare earth based magnet that is applicable even at a high temperature environment may be provided.

DESCRIPTION OF REFERENCE NUMERALS

1 Main phase crystal grains
2 Grain boundary phase

What is claimed is:

1. A rare earth based sintered magnet, comprising:

$R_2T_{14}B$ main phase crystal grains and grain boundary phases between adjacent main phase crystal grains, wherein the grain boundary phases comprise an antiferromagnetic compound $Nd_6Fe_{13}Ga$ phase, in any cross-section of said rare earth based sintered magnet observed by an electron microscope, circular degree of the main phase crystal grains is denoted by Roundness A and the Roundness A of five grains with different sizes is measured, and the average measured value thereby obtained is 0.24 or more and 0.36 or less, said rare earth based sintered magnet does not contain heavy rare earth elements, said rare earth based sintered magnet contains C, O and N, and the relation of $[O]/([C]+[N])<0.60$ is satisfied, wherein [C] is the molar amount of C, [O] is the molar amount of O, and [N] is the molar amount of N, said Roundness A is defined by the following formula (1), $$A=\Sigma r_i/(Rn) \quad (1)$$

wherein, $r_i$ represents a radius of a circle inscribed in a corner of a selected crystal grain, R represents a radius of the biggest circle inscribed in the selected crystal grain, n represents the number of the corners of the selected crystal grain, Σ represents the sum of the corners of the selected crystal grain, and said rare earth based sintered magnet has an absolute value of a demagnetization rate D at a high temperature is 0.77% or less, in which $$D=100\times(B1-B0)/B0(\%),$$

B0: residual magnetic flux at room temperature (25° C.), and

B1: residual magnetic flux brought back to room temperature after being exposed to a temperature of 140° C. for 2 hours.

2. The rare earth based magnet according to claim 1, wherein said grain boundary phases further comprise a non-magnetic R-rich phase.

3. The rare earth based magnet according to claim 1, wherein $[O]/([C]+[N])$ is 0.45 or less.

4. The rare earth based magnet according to claim 1, wherein $[O]/([C]+[N])\leq 0.51$.

* * * * *